US008127695B2

(12) United States Patent
MacDonald et al.

(10) Patent No.: US 8,127,695 B2
(45) Date of Patent: Mar. 6, 2012

(54) DISPLAY STAND WITH TABLE

(75) Inventors: Mark R. MacDonald, Minnetonka, MN (US); Robert W. Stimson, Bloomington, MN (US)

(73) Assignee: Aisle Advertising, Minnetonka, MN (US)

( * ) Notice: Subject to any disclaimer, the term of this patent is extended or adjusted under 35 U.S.C. 154(b) by 182 days.

(21) Appl. No.: 12/333,172

(22) Filed: Dec. 11, 2008

(65) Prior Publication Data

US 2010/0148024 A1 Jun. 17, 2010

(51) Int. Cl.
*A47B 3/00* (2006.01)

(52) U.S. Cl. ..... 108/115; 108/48; 108/153.1; 108/180; 108/35; 312/313; 312/258; 312/265.5

(58) Field of Classification Search ..... 108/180, 108/153.1, 11, 12, 13, 14, 17, 18, 33, 38, 108/41, 26, 50.01, 115, 48, 35; 40/606.08; 312/265.5, 249.8, 223.3, 223.5, 258, 261, 312/313, 317.3, 348.4, 348.5, 204, 257.1, 312/270.2

See application file for complete search history.

(56) References Cited

U.S. PATENT DOCUMENTS

| | | | | |
|---|---|---|---|---|
| 316,928 | A * | 4/1885 | Wysong | 108/14 |
| 1,055,884 | A * | 3/1913 | Davidson | 312/231 |
| 1,376,608 | A * | 5/1921 | Curtiss | 312/223.3 |
| 1,571,098 | A * | 1/1926 | Rimke | 40/606.08 |
| 2,122,969 | A | 7/1938 | Whitcomb | |
| 2,499,062 | A | 2/1950 | Greenberg | |
| 2,547,808 | A | 4/1951 | Burrage | |
| 3,697,363 | A * | 10/1972 | Martinez | 312/265.5 |
| D275,250 | S | 8/1984 | Kirsner | |
| 4,993,782 | A | 2/1991 | Williams | |
| D381,529 | S | 7/1997 | Ugalde | |
| 6,095,056 | A * | 8/2000 | Schumacher | 108/23 |
| 6,240,855 | B1 | 6/2001 | Pirkl et al. | |
| 7,278,644 | B2 | 10/2007 | Villarreal | |
| 7,314,010 | B2 * | 1/2008 | George et al. | 108/50.01 |
| 7,387,151 | B1 * | 6/2008 | Payne | 312/204 |
| 7,665,709 | B2 * | 2/2010 | Cvek | 108/50.01 |
| 2002/0145368 | A1 * | 10/2002 | Brown | 312/313 |
| 2004/0226210 | A1 * | 11/2004 | Kaur | 40/606.08 |
| 2006/0076858 | A1 * | 4/2006 | Nohl | 312/257.1 |

FOREIGN PATENT DOCUMENTS

| | | | |
|---|---|---|---|
| EP | 0575275 | A1 | 12/1993 |
| JP | 1005059 | A2 | 1/1998 |
| WO | WO2010068832 | | 6/2010 |

OTHER PUBLICATIONS

"PCT International Search Report and Written Opinion", from International Application No. PCT/US2009/067617, corresponding to U.S. Appl. No. 12/333,172, mailed Mar. 25, 2010, pp. 1-24.

* cited by examiner

*Primary Examiner* — Jose V Chen
(74) *Attorney, Agent, or Firm* — Pauly, Devries Smith & Deffner, L.L.C.

(57) ABSTRACT

In an embodiment, a display stand including a display stand housing is included. The display stand housing can be configured to hold one or more graphic panels. The display stand housing can define a table pocket. The display stand also includes a table assembly configured to move between a stored configuration and a deployed configuration. The table assembly can be configured to be disposed within the table pocket and concealed from view by at least one of the graphic panels when in the stored configuration. The display stand housing can further include a counter top panel disposed over the display stand housing. Other embodiments are also included herein.

17 Claims, 11 Drawing Sheets

DISPLAY STAND WITH TABLE

FIELD OF THE INVENTION

The invention relates to display stands. More specifically, the invention relates to display stands including a table that can be concealed from view.

BACKGROUND OF THE INVENTION

Display stands are useful for displaying products, information and commercial graphics in a highly aesthetic manner. As such, display stands, including kiosks, have many applications within malls, stores, and exhibition areas. In comparison to simple wall-based display of graphics, the use of display stands can be advantageous because the graphics can be attractively positioned in virtually any area of a store or other enclosed space. Display stands are frequently used for selling goods such as food, mobile phones, seasonal goods, and the like.

There is a substantial range of physical specifications for display stands. Display stands may be relatively small or quite large. Display stands may be portable or substantially permanent. Display stands may be designed to be staffed by a sales representative or may be designed to be used unmanned.

SUMMARY

The invention relates to display stands including a table. In an embodiment the invention includes a display stand including a front wall configured to hold a first graphic panel. The display stand further includes a back wall disposed opposite of the front wall, the back wall including a door. The display stand further includes a first side wall, the first side wall defining a pocket, the first side wall configured to hold a second graphic panel. The display stand further includes a table assembly configured to be moved between a stored position wherein the table assembly is disposed within the pocket of the first side wall and a deployed position wherein a portion of the table assembly extends perpendicularly from the first side wall. The display stand further includes a counter top panel disposed over the front wall, back wall, and first side wall.

In an embodiment the invention includes a display stand including a display stand housing, the display stand housing configured to hold one or more graphic panels, the display stand housing defining a table pocket; a table assembly configured to move between a stored configuration and a deployed configuration, the table assembly configured to be disposed within the table pocket and concealed from view by at least one of the graphic panels when in the stored configuration; and a display counter top panel disposed over the display stand housing.

The above summary of the present invention is not intended to describe each discussed embodiment of the present invention. This is the purpose of the figures and the detailed description that follows.

BRIEF DESCRIPTION OF THE DRAWINGS

The invention may be more completely understood in connection with the following drawings, in which.

Figure 1:
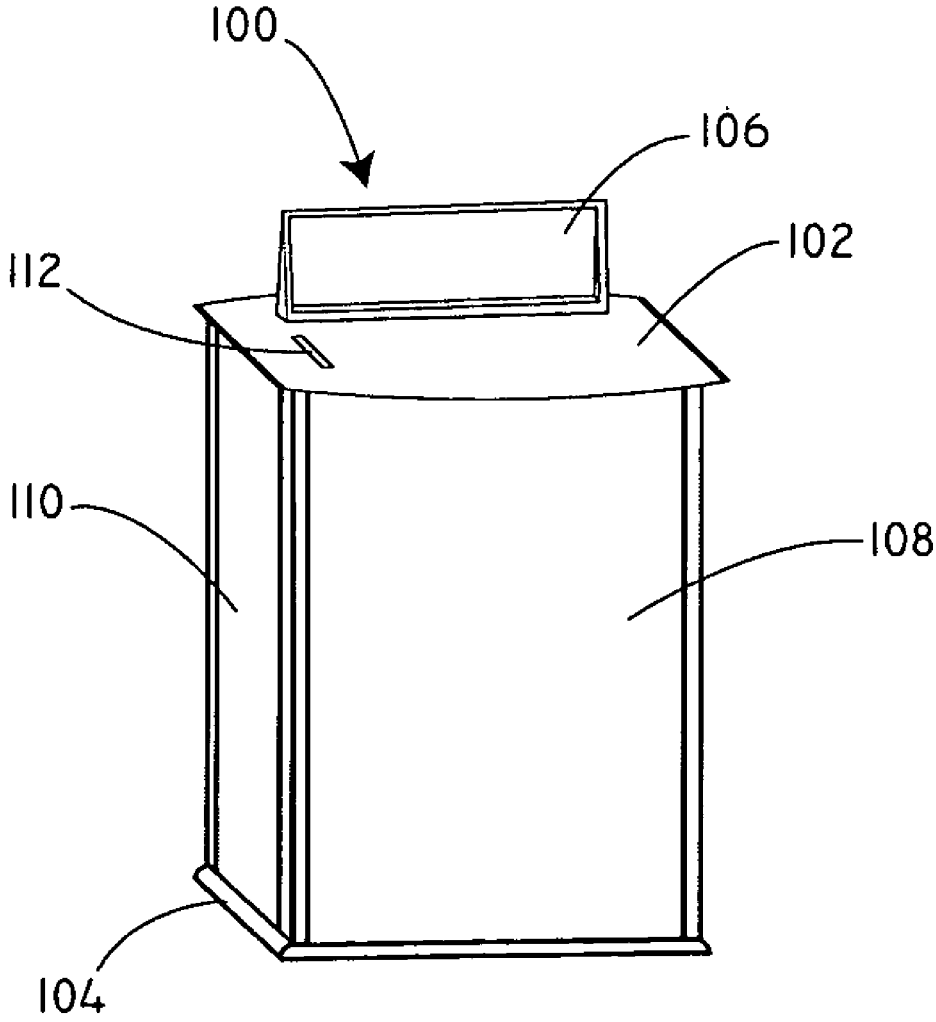
FIG. 1 is a schematic perspective view of a display stand in accordance with an embodiment.

While the invention is susceptible to various modifications and alternative forms, specifics thereof have been shown by way of example and drawings and will be described in detail. It should be understood, however, that the invention is not limited to the particular embodiments described. On the contrary, the intention is to cover modifications, equivalents, and alternatives falling within the spirit and scope of the invention.

DETAILED DESCRIPTION OF THE INVENTION

As described above, display stands have many applications within malls, stores, and exhibition areas. In some circumstances, potential customers may approach the display stand interested in obtaining literature about products or services. In this scenario, the customer will likely be in a standing position and so it can be advantageous to have product literature displayed at a convenient height for a standing customer as well as have a counter top for a standing customer to fill out paper work.

However, there are times where potential customers may wish to speak with a customer service representative about a product or service for an extended period of time. In such a scenario, it is more convenient if the customer can sit at a table, across from a customer service representative, when asking such questions.

Embodiments included herein can address circumstances where customers are standing as well as circumstances where customers wish to sit down. Specifically, embodiments of the present invention can include display stands with table assemblies that can be deployed in order to provide an area where customers can sit.

Aesthetics can be very important in retail environments. In this regard, various embodiments herein allow the table assembly to be stored within the display stand and concealed from view by a graphic panel when the table assembly is not in use.

By way of example, in an embodiment, the invention includes a display stand including a front wall that can be configured to hold a first graphic panel. The display stand can further include a back wall disposed opposite of the front wall, the back wall including a door. The display stand can further include a first side wall. The first side wall can define a recessed pocket or table pocket. In addition, the first side wall can be configured to hold a second graphic panel. The display stand can further include a table assembly configured to be moved between a stored position wherein the table assembly is disposed within the pocket of the first side wall and a deployed position wherein a portion of the table assembly extends perpendicularly from the first side wall. The display stand can further include a counter top panel disposed over the front wall, back wall, and first side wall.

Beyond the flexibility of use afforded by the table assembly that can be selectively deployed and then stored, many other benefits can also be achieved with various embodiments herein. For example, in many embodiments herein the table assembly can be deployed and then stored without the use of specialized tools. In addition, multiple embodiments included herein can be used both indoors and outdoors. Finally, the use of removable graphic panels in various embodiments herein allows quick and easy changing of graphics. However, it will be appreciated that the specific benefits provided by a particular embodiment depend on the features included with that embodiment and thus not all benefits may be provided by all embodiments included within the scope herein.

Further aspects of exemplary embodiments will now be described in greater detail. Referring now to FIG. 1, a schematic perspective view of a display stand 100 is shown in accordance with an embodiment. The display stand 100 includes a front wall 108. The display stand 100 can further include a base unit 104. The display stand 100 can further include a side wall 110 and a counter top panel 102.

The height of the display stand 100 up to the level of the top panel 102 can be made so that it is convenient for a person to interface with materials at the height of the top panel 102 while in a standing position. As such, the height of the display stand 100 can be of various heights. For example, in some embodiments, the height of the display stand 100 can be from about 30 inches to about 60 inches. In some embodiments, the height of the display stand 100 can be about 42 inches.

A drop slot 112 in the top panel 102 can provide access to the interior volume of the display stand 100. As such, the drop slot 112 can pass completely through the thickness of the top panel 102. In some embodiments, one or more shelves (not shown) can be disposed within the interior volume of the display stand. For example, a receptacle can be placed on a shelf within the interior volume of the display stand and positioned below the drop slot 112 in order to catch customer response cards that may be dropped in. In some embodiments, retaining straps can be disposed within the interior volume and can be used to secure items, such as chairs, during shipping of the display stand 100.

In some embodiments, a literature rack 106 can be disposed on the top panel 102. The literature rack 106 can provide an area to hold product or service literature in an organized manner. The display stand 100 can include a table assembly. However, in FIG. 1, the table assembly is in a stored position, and cannot be seen from the outside. For example, the table assembly can be concealed from view by a graphic panel held by the side wall 110.

Figure 2:
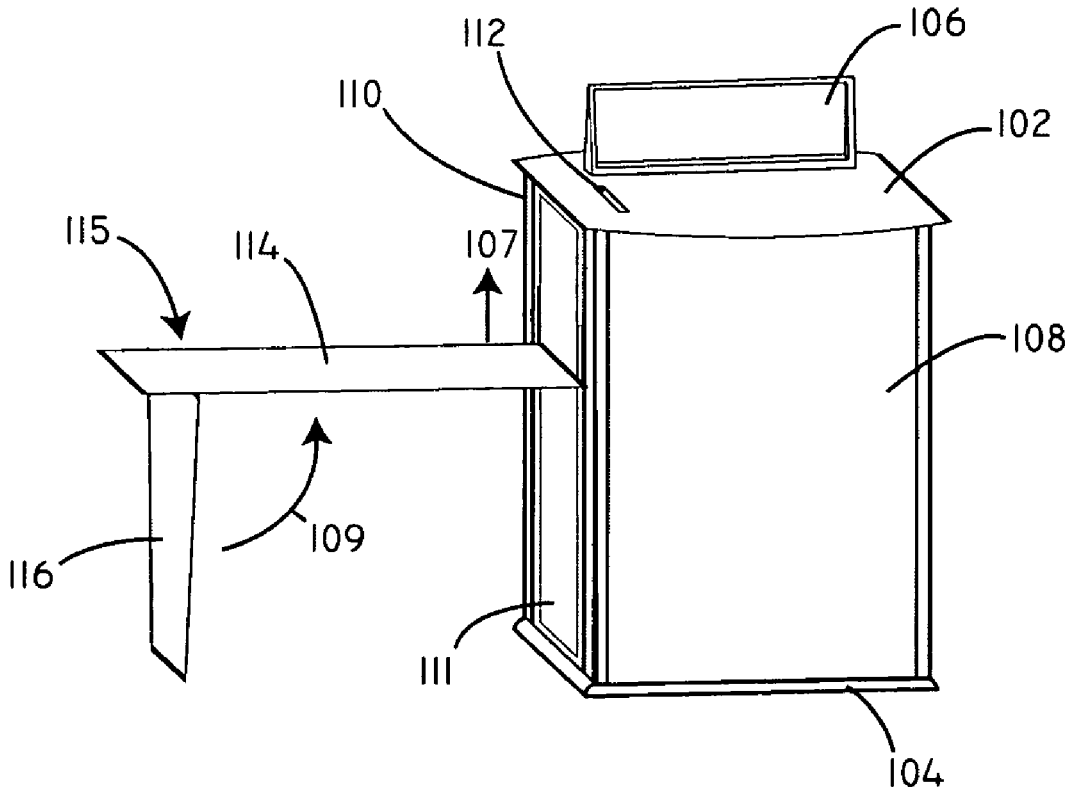
FIG. 2 is a schematic perspective view of a display stand with a table assembly in a deployed position in accordance with an embodiment.

FIG. 2 is a schematic perspective view of the display stand 100 with the table assembly 115 in a deployed position in accordance with an embodiment. The table assembly 115 can include a table top 114 and a table leg 116. In some embodiments, a mechanism can be used in order to lock the table leg 116 in place to provide adequate support for the table top 114. As such, the table leg 116 can be a locking folding table leg. In a particular embodiment, the mechanism to lock the table leg 116 in place can include a wire cable (not shown) secured to the bottom of the table top 114 and the table leg 116 to stop the table leg 116 from moving out too far and a strut (not shown) that can be positioned between the table top 114 and the table leg 116 to prevent the table leg 116 from moving in too far. However, it will be appreciated that many other types of mechanisms can be used to lock the table leg 116 in place. While a single table leg is shown in the embodiment of FIG. 2, in some embodiments, the table assembly 115 can include multiple table legs.

The side wall 110 can define a recessed pocket 111 (or storage area) in order to hold the table assembly 115, when the table assembly 115 is folded into a stored position. For example, the table leg 116 can fold up against the table top 114 by moving in the direction of arrow 109. In some embodiments the pocket 111 can simply be a void in the side wall 110. In other embodiments, the pocket 111 can be defined by sides and a back and thus be at least semi-enclosed.

The distance between the floor and the table top 114 can be sufficient to facilitate a person sitting on a chair at the table. For example, the distance between the floor and the table top 114 can be from about 29 inches to about 37 inches. The length of the table leg can be sufficient to support the table top 114. In some embodiments, the length of the table leg can be about 28 to 36 inches. The table assembly 115 can pivot into the pocket 111 along the axis where the table assembly 115 intersects the side wall 110. Alternatively, to accommodate longer table top 114 lengths, the edge of the table top 114 can slide upward in the direction of arrow 107 along a slot formed in the side wall 110, before pivoting into the pocket 111. The length of the table top 114 can vary depending on the end use of the display stand. For example, in some embodiments, the length of the table 114 can be from about 29 inches to about 38 inches. In a particular embodiment, the length of the table top 114 can be about 31 inches.

Figure 3:
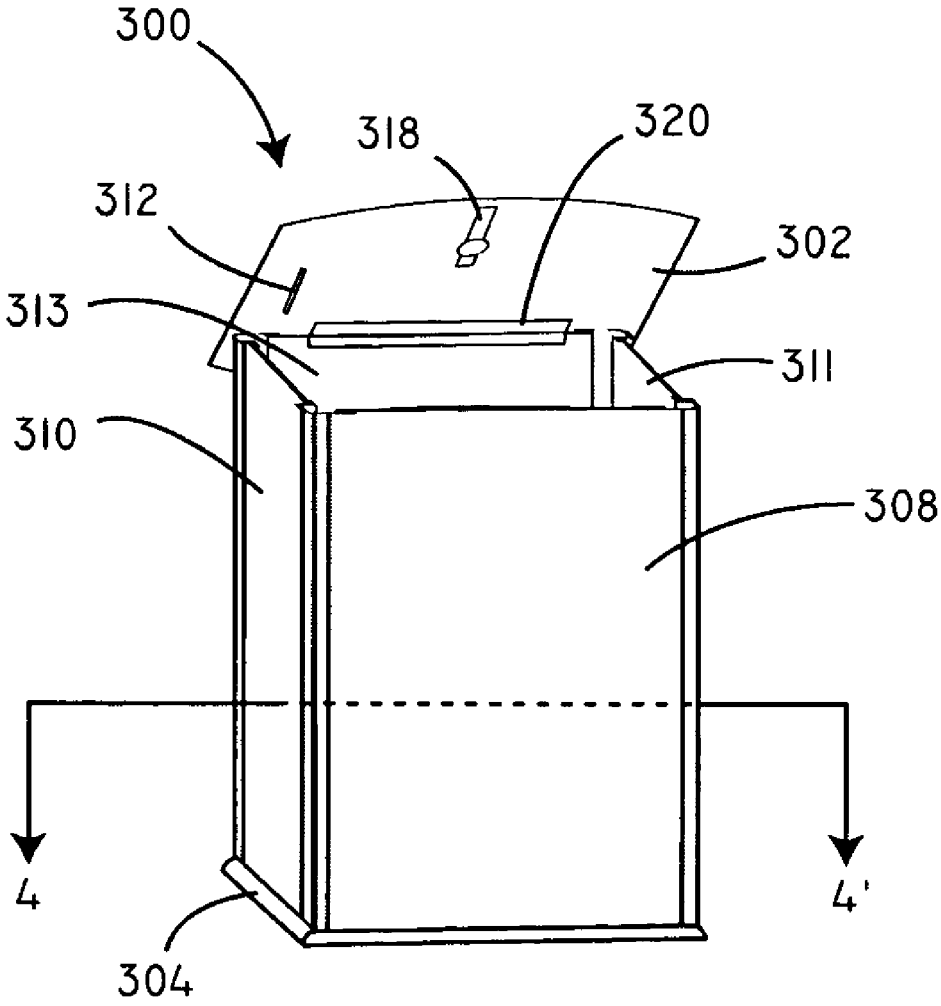
FIG. 3 is a schematic perspective view of a display stand with counter top panel lifted up in accordance with an embodiment.

FIG. 3 is a schematic perspective view of a display stand 300 with a counter top panel 302 lifted-up in accordance with an embodiment. The display stand 300 can include a base unit 304, a front wall 308, a first side wall 310, a second side wall 311, and a back wall 313. The top panel 302 can pivot with respect to the back wall 313 along an axis where the top panel 302 intersects the back wall 313. In some embodiments, the counter top panel 302 can be coupled to the back wall 313 with a hinge 320. In some cases, a locking mechanism 318 can be disposed on the inside surface of the top panel 302. The locking mechanism 318 can interface with the front wall 308, or a structure disposed thereon, and can function to prevent an individual from lifting up the top panel 302 unless the locking mechanism 318 is released.

Figure 4:
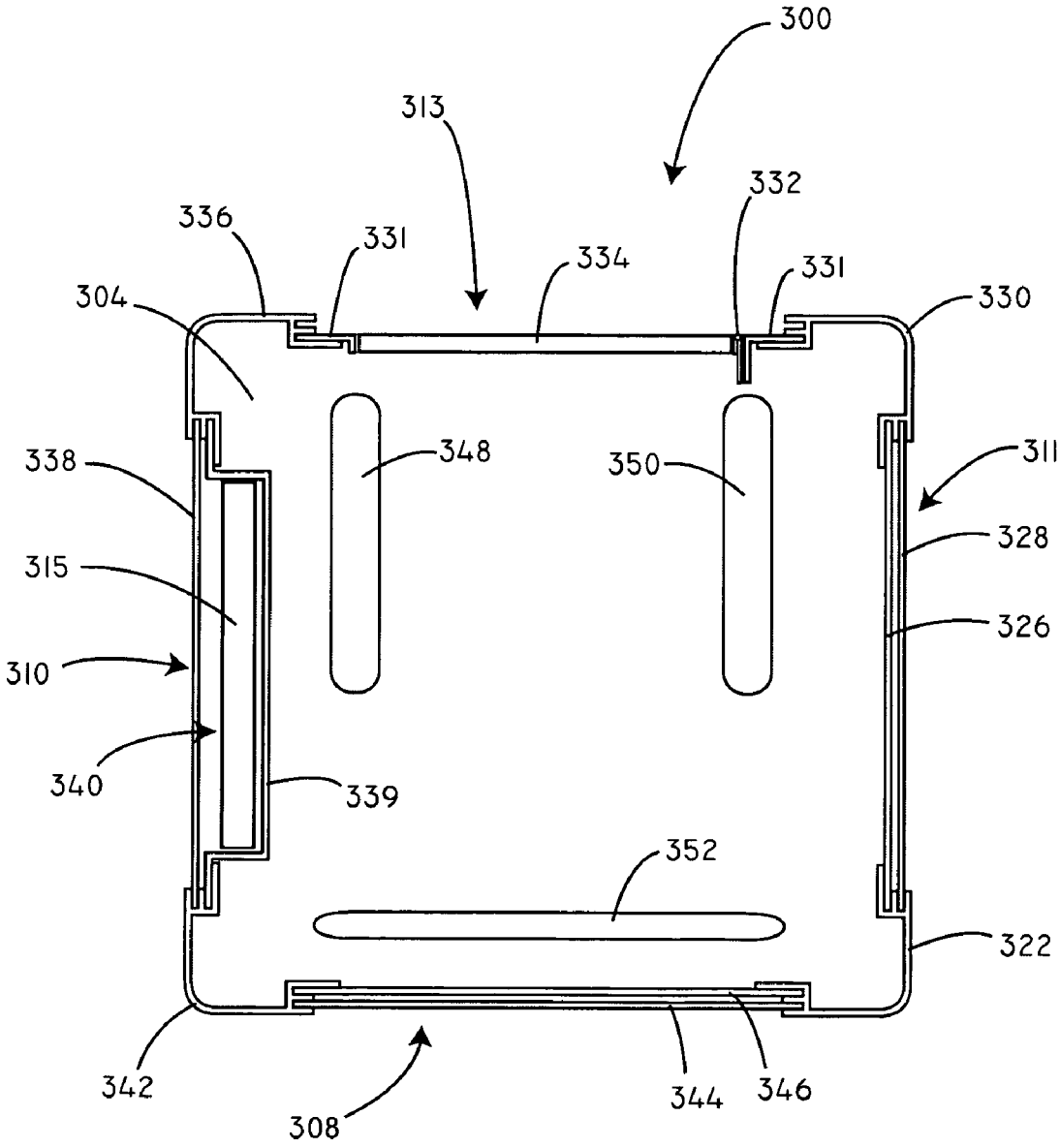
FIG. 4 is a cross-sectional view of a display stand as taken along line 4-4' of FIG. 3.

FIG. 4 is a cross-sectional view of the display stand 300 as taken along line 4-4' of FIG. 3. In this embodiment, the display stand 300 includes four corner pieces 322, 330, 336, 342 that are at the intersections of the front wall 308, first side wall 310, back wall 313, and second side wall 311. The corner pieces can serve to add structural strength to the display stand 300. Various materials can be used to make the corner pieces. By way of example, the corner pieces can be a polymer, metal, ceramic, composite, cellulosic material, or the like. In some embodiments the corner pieces can be formed from an extruded metal, such as extruded aluminum.

The front wall 308 can include a structural panel 346 that is coupled to corner piece 322 and to corner piece 342. The front wall 308 can also be configured to hold a graphic panel 344. The front wall can define a vertical channel into which the graphic panel 344 can be slid. For example, in an embodiment, the graphic panel 344 can be slid into a vertical channel defined by corner piece 322 and corner piece 342. In other embodiments, the graphic panel 344 can be held in place using a clip or other type of fastener. In some embodiments, the graphic panel 344 can be held in place using a magnet or a fastening product such as VELCRO.

The first side wall 310 can include a structural panel 339 that is coupled to corner piece 342 and to corner piece 336. Structural panel 339 can define a recessed pocket 340 that can hold table assembly 315. The first side wall 310 can also be configured to hold a graphic panel 338. The first side wall 310 can define a vertical channel into which the graphic panel 338 can be slid. For example, in an embodiment, the graphic panel 338 can be slid into a vertical channel defined by corner piece 342 and corner piece 336. The graphic panel 338 can obscure the table assembly 315 from view from the outside of the display stand.

In the embodiment shown in FIG. 4, the table assembly 315 is associated with the first side wall 310. However, it will be appreciated that in other embodiments the table assembly 315 could alternatively be associated with the second side wall 311 or the front wall 308.

The back wall 313 can include a door 334 arranged to open and provide secured access to the interior volume of the display stand. For example, the door 334 can be mounted on a hinge 332. The back wall 313 can include a structural panel 331 that is coupled to corner piece 336 and corner piece 330. The second side wall 311 can include a structural panel 326 that is coupled to corner piece 330 and corner piece 322. The second side wall 311 can also be configured to hold a graphic panel 328. The second side wall can define a vertical channel into which the graphic panel 328 can be slid. For example, in an embodiment, the graphic panel 328 can be slid into a vertical channel defined by corner piece 330 and corner piece 322.

The base unit 304 can be made of various materials including polymers, metals, composites, cellulosic materials, and the like. In some embodiments the base unit is a vacuum-formed polymer. In some embodiments, the base unit is ABS plastic. In some embodiments the base unit 304 can include a top surface that defines a pair of depressions 348, 350 spaced a distance apart. The depressions 348, 350 can be configured to receive the feet of a folding chair (not shown) that can be stored within the display stand 300. In some embodiments, the base unit 304 can also include an elevated portion 352. Graphic panels used with the display stand can be stored within the display stand when not in use. The space between the elevated portion 352 and the front wall 308 can serve to hold the bottom portion of graphic panels that are being stored within the display stand 300. The outside edge of the base unit 304 can be molded to serve as a toe-kick to protect the display stand from damage that may be caused by pedestrians' feet or cleaning machines. For example, the outside edge of the base unit 304 can include a portion that sticks out from the walls of the display stand 300 and therefore prevents an object (such as a pedestrian's shoe) at the height of the floor from contacting the walls of the display stand 300.

The structural panels 346, 339, 331, 326 of the display stand can be made of various materials. For example, the structural panels can be made of a polymer, metal, cellulosic material, ceramic, composite, or the like. In some embodiments the structural panels are made of ABS plastic. The graphic panels 328, 344, 338 can be made of various materials and then graphics can be printed onto or otherwise layered onto an outer surface of the graphic panels. In a particular embodiment, the graphic panels are made of SINTRA® brand polyvinyl chloride polymer.

Figure 5:
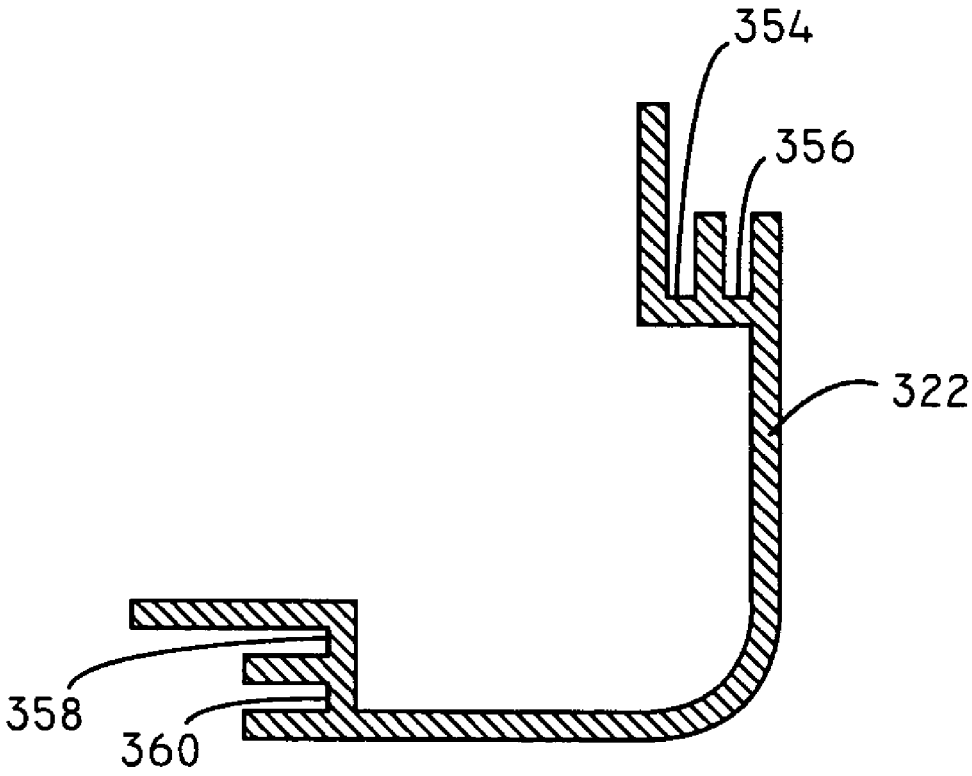
FIG. 5 is a cross-sectional view of a corner piece in accordance with an embodiment.

FIG. 5 is an enlarged cross-sectional view of corner piece 322. Corner piece 322 defines four separate "U-shaped" channels 354, 356, 358, 360. Channels 354 and 356 are disposed facing a first direction while channels 358 and 360 are disposed facing a second direction. In some embodiments, the first direction and the second direction are substantially perpendicular to one another. In various embodiments corner pieces 342, 336, and 330 can be similar to that shown in FIG. 5 with respect to corner piece 322. Channels 354 and 358 can receive structural panels while channels 356 and 360 can receive graphic panels. The width of channels 356 and 360 can be larger than the thickness of the graphic panels so that the graphic panels can slide in and out of the channels with relative ease.

Figure 6:
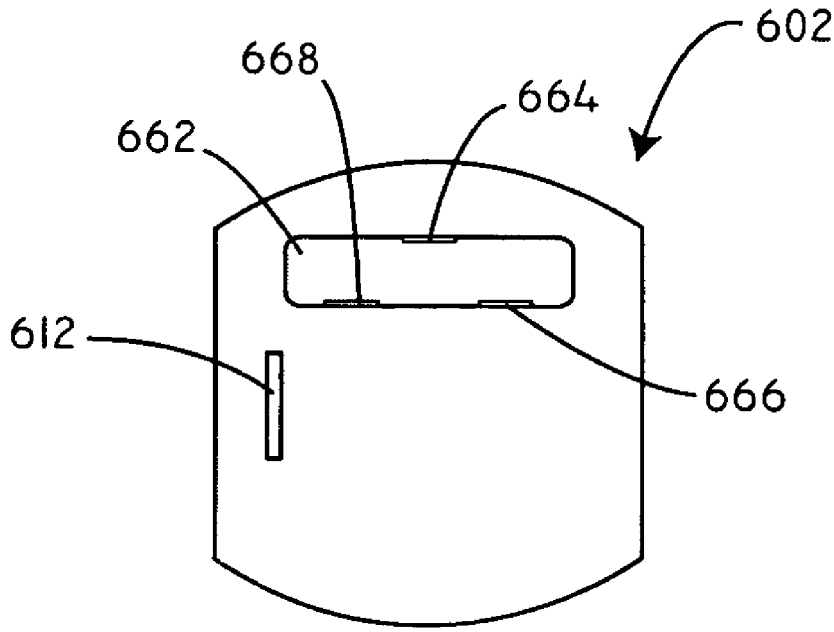
FIG. 6 is a schematic top view of a counter top panel in accordance with an embodiment.

Referring now to FIG. 6, a schematic top view of a counter top panel 602 is shown in accordance with an embodiment. The top panel 602 can include a drop slot 612 that can pass completely through the top panel 602. The counter top panel 602 can further define a depression 662 that can be configured to receive a literature rack. The top panel 602 can include tab receptacles 664, 666, 668 configured to mate with fixation tabs on a literature rack.

Figure 7:
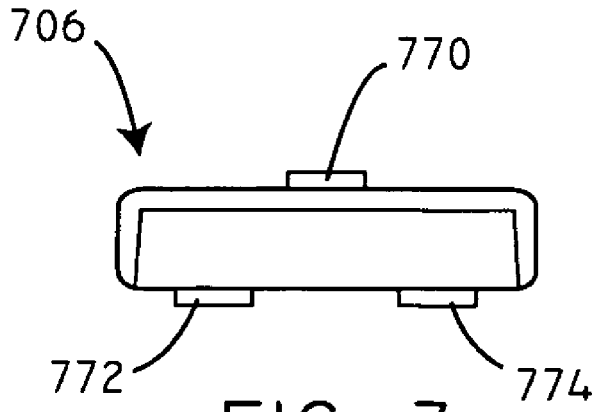
FIG. 7 is a schematic top view of a literature rack in accordance with an embodiment.

FIG. 7 is a schematic top view of a literature rack 706 in accordance with an embodiment. The literature rack 706 can include fixation tabs 770, 772, 774 that can mate with tab receptacles on the top panel of the display stand. When the fixation tabs 770, 772, 774 are mated with the corresponding tab receptacles, the literature rack 706 can be fixed in place on top of the top panel. However, in this manner, the literature rack 706 can also be quickly removed without requiring the use of special tools. For example, the literature rack 706 can be flexed so that the fixation tabs are removed from the corresponding tab receptacles, allowing the literature rack 706 to be removed from the top panel. It will be appreciated that the literature rack 706 can have various physical configurations and that the embodiment shown in FIG. 7 is simply one example of a literature rack.

Figure 8:
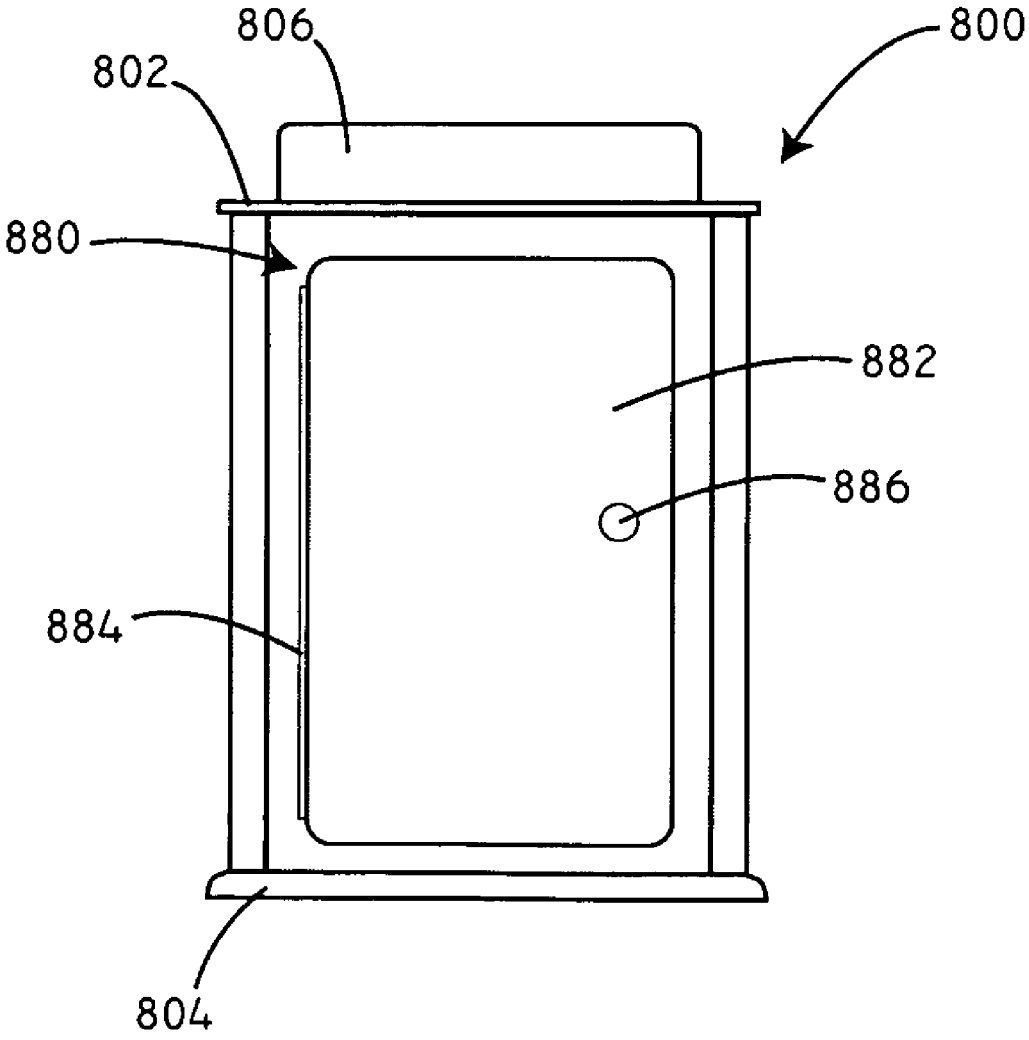
FIG. 8 is a schematic back view of a display stand in accordance with an embodiment.

FIG. 8 is a schematic back view of a display stand 800 in accordance with an embodiment. The display stand 800 includes a base unit 804, a back wall 880, a top panel 802, and a literature rack 806. The back wall 880 can include a door 882 that can pivot around the center of a hinge 884. In some embodiments, the door 882 can include a locking mechanism 886. The locking mechanism 886 can be a key-type locking mechanism, a combination-type locking mechanism, or the like, and can serve to prevent unauthorized opening of the door 882.

Figure 9:
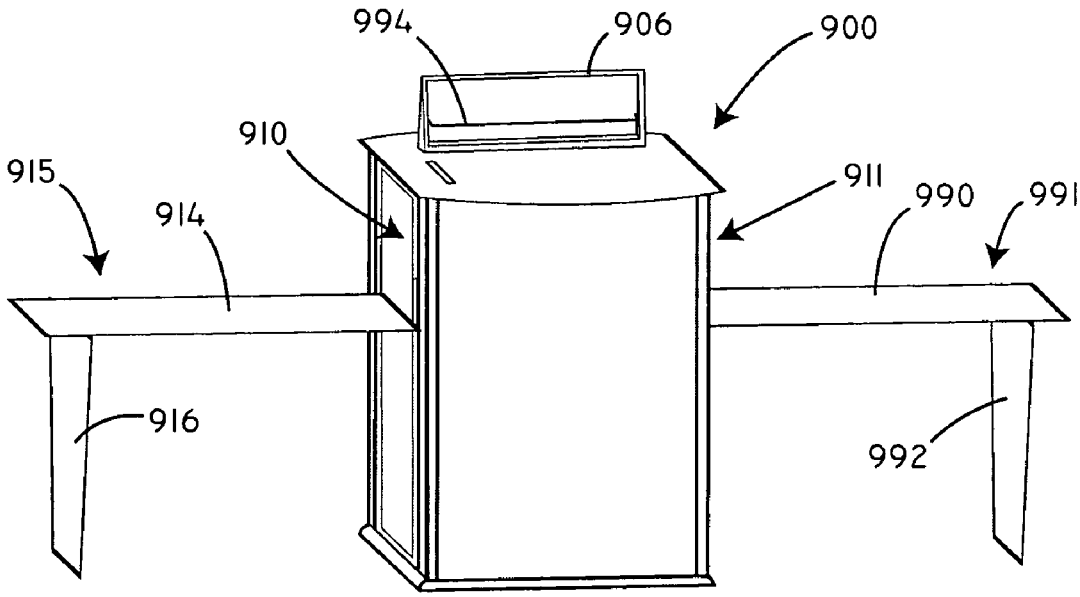
FIG. 9 is a schematic perspective view of a display stand with two table assemblies in a deployed position in accordance with an embodiment.

In some embodiments, display stands in accordance with embodiments herein can include more than one table assembly. FIG. 9 is a schematic perspective view of a display stand 900 with two table assemblies 915, 991 in a deployed position in accordance with an embodiment. First table assembly 915 includes a table top 914 and a table leg 916. First table assembly 915 is configured to fit within or behind first side wall 910. Table top 914 is substantially perpendicular to first side wall 910 when the table assembly 915 is in a deployed position. Second table assembly 991 includes a table top 990 and a table leg 992. Second table assembly 991 is configured to fit within or behind second side wall 911. Table top 990 is substantially perpendicular to second side wall 911 when the table assembly 991 is in a deployed position. In some embodiments, display stands in accordance with embodiments herein can include three table assemblies or more.

In some embodiments a literature rack may include a retaining mechanism in order to hold product literature in place. By way of example, the embodiment of FIG. 9 shows a literature rack 906 including a retaining bar 994. In this embodiment the retaining bar 994 can be made from a metal wire. However, it will be appreciated that various other materials may be used to form the retaining bar 994. In addition, it will be appreciated that retaining mechanisms may include other structures instead of, or in addition to, a retaining bar.

Figure 10:
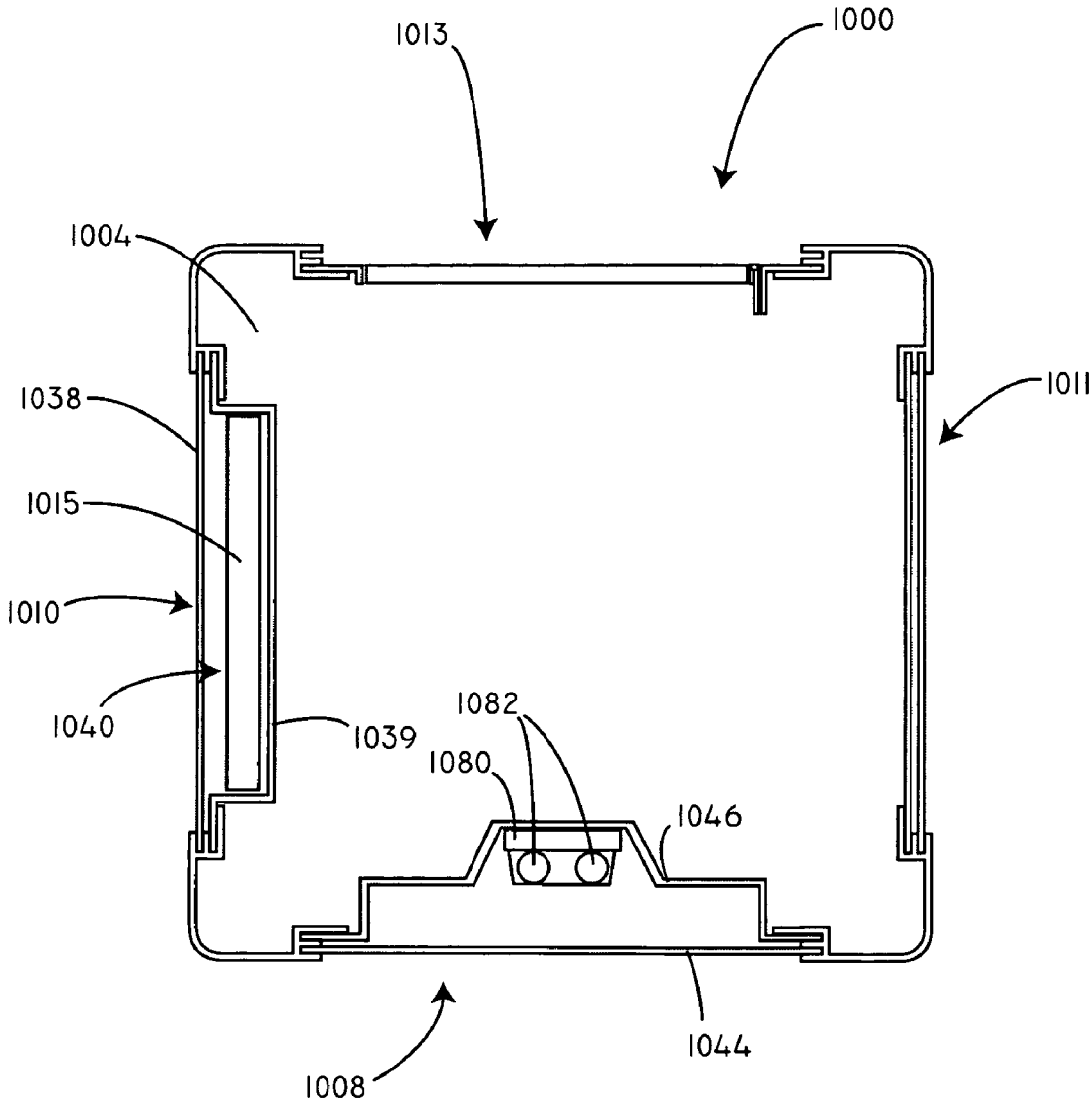
FIG. 10 is a schematic cross-sectional view of a display stand including a light box in accordance with another embodiment of the invention.

In some embodiments, display stands can include a light source in order to illuminate graphic panels held by the display stands. Illumination of graphic panels can either be from the front or from the back of the graphic panels. Various types of light sources can be used. By way of example, exemplary light sources can include light emitting diodes (LEDs), incandescent lights, fluorescent lights, and the like. Referring now to FIG. 10, a schematic cross-sectional view of a display stand 1000 is shown including a light source 1080. The display stand 1000 can include a base unit 1004, a front wall 1008, a first side wall 1010, a second side wall 1011, and a back wall 1013. The front wall 1008 can include a structural panel 1046 and can be configured to hold a graphic panel 1044. A light source 1080, including fluorescent lights 1082, can be disposed behind the graphic panel 1044, thereby providing backlighting of the graphic panel 1044. The first side wall 1010 can include a structural panel 1039 and can be configured to hold a graphic panel 1038. Structural panel 1039 can define a pocket 1040 that can hold table assembly 1015.

In some embodiments, a display stand can include a video screen in order to display text and/or graphics to potential customers. In various embodiments the video screen can be coupled to a component of the display stand. By way of example, the video screen can be coupled to the counter top panel of the display stand. Though in other embodiments the video screen can be substantially free standing.

Figure 11:
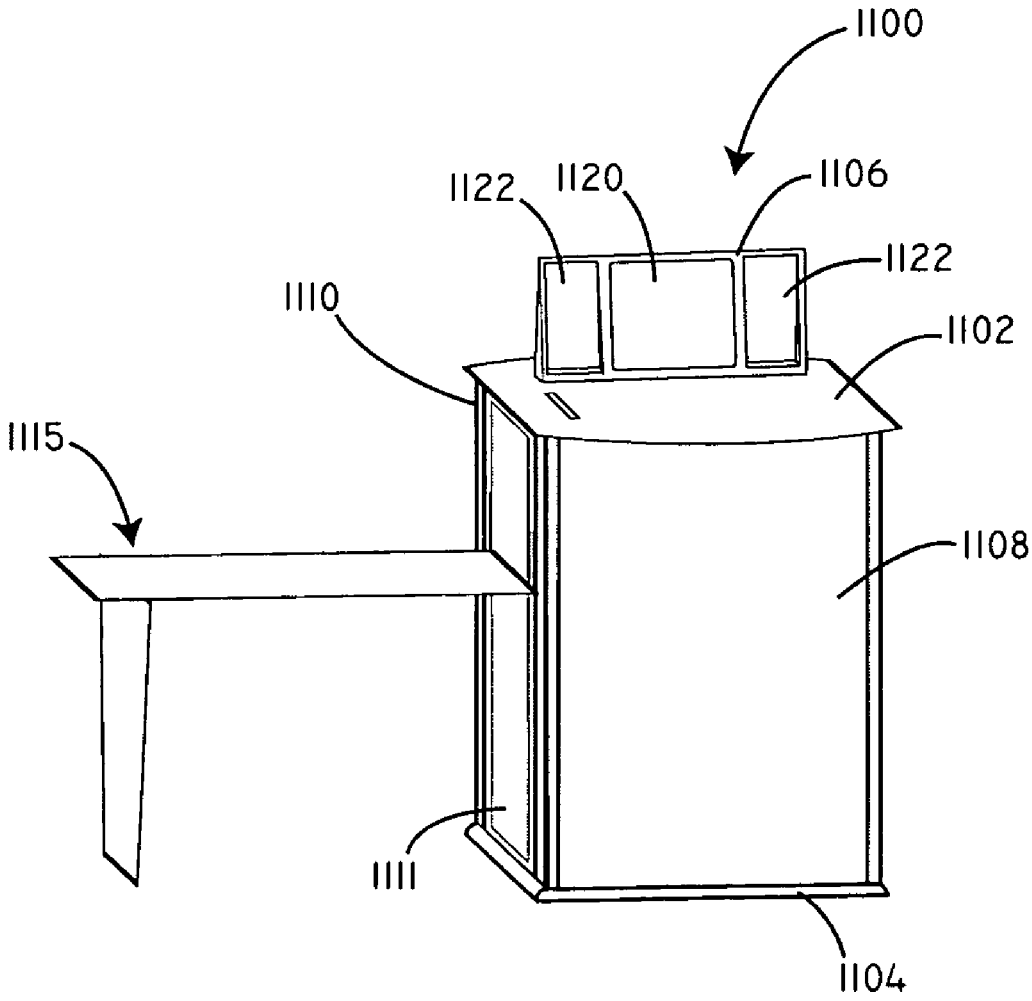
FIG. 11 is a schematic view of a display stand including a video screen in accordance with another embodiment of the invention.

Referring now to FIG. 11 an embodiment of a display stand 1100 including a video screen 1120 is shown. The video screen 1120 can be part of a literature rack 1106 that also includes recessed portions 1122 for holding product literature. In this embodiment, the video screen 1120 is coupled to the counter top panel 1102 through the literature rack 1106. However, it will be appreciated that in some embodiments the video screen 1120 can also be separate from the literature rack 1106. In some embodiments the video screen 1120 can be a LCD screen.

The display stand 1100 can include a table assembly 1115 and a side wall 1110 defining a recessed pocket 1111 (or storage area) in order to hold the table assembly 1115, when the table assembly 1115 is folded into a stored position. The display stand 1100 can also include a front wall 1108, and a base unit 1104. In some embodiments, the video screen 1120 can be coupled to the front wall 1108.

Figure 12:
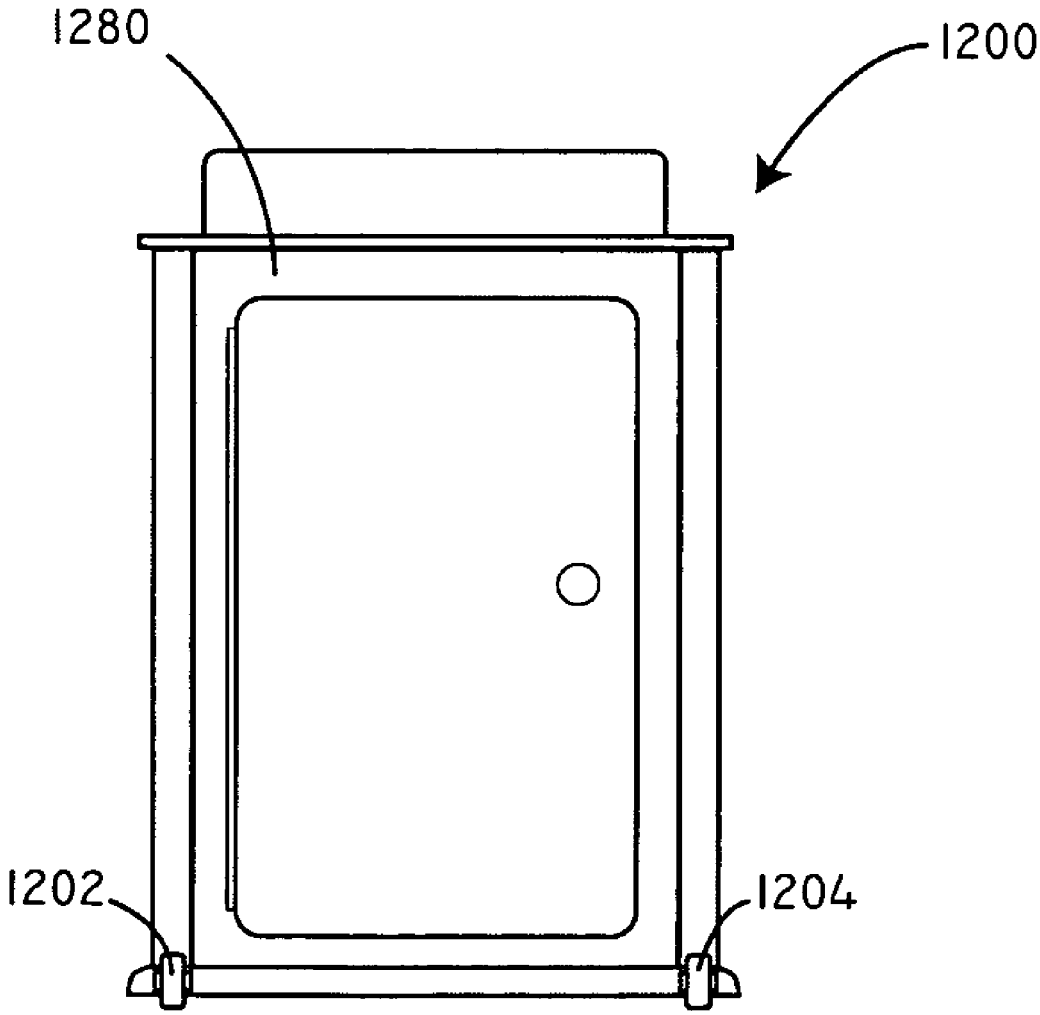
FIG. 12 is a schematic view of a display stand including wheels in accordance with another embodiment of the invention.

In some embodiments the display stand can include wheels to increase the mobility of the unit. Referring now to FIG. 12, a schematic view is shown of a display stand 1200 including wheels 1202 and 1204. In this embodiment, the wheels 1202, 1204 are adjacent to the back panel 1280. However, it will be appreciated that the wheels 1202 and 1204 could also be on other sides of the display stand 1200.

It should be noted that, as used in this specification and the appended claims, the singular forms "a", "an", and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, adapted, constructed, manufactured and arranged, and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

The invention has been described with reference to various specific embodiments and techniques. However, it should be understood that many variations and modifications may be made while remaining within the spirit and scope of the invention.

The claims are:

1. A display stand comprising:

a front wall comprising opposing vertical channels adjacent side edges of the front wall configured to hold a first graphic panel between the opposing vertical channels;

a back wall disposed opposite of the front wall, the back wall comprising a door;

a first side wall, the first side wall including a recessed portion defining a pocket, the first side wall comprising opposing vertical channels adjacent side edges of the first side wall configured to hold a second graphic panel between the opposing vertical channels;

a table assembly intersecting the first side wall configured to be moved between a stored position wherein the table assembly is disposed within the pocket of the first side wall and a deployed position wherein a portion of the table assembly extends substantially perpendicularly to the first side wall, by pivoting along an axis where the table assembly intersects the first side wall; and a counter top panel disposed over the front wall, back wall, and first side wall.

2. The display stand of claim 1, wherein the table assembly is concealed from view when the table assembly is in the stored position and the second graphic panel is held by the first side wall.

3. The display stand of claim 1, the table assembly comprising a table top and a locking folding leg.

4. The display stand of claim 1, the counter top panel coupled to the back wall with a hinge.

5. The display stand of claim 1, further comprising a literature rack removably coupled to the counter top panel.

6. The display stand of claim 5, the counter top panel comprising a depression configured to receive the literature rack.

7. The display stand of claim 1, further comprising a base unit coupled to the front wall, back wall, and first side wall, the base unit having a top surface, the top surface of the base unit comprising a pair of depressions configured to receive the feet of a chair.

8. The display stand of claim 1, further comprising a second side wall disposed opposite the first side wall, the second side wall comprising opposing vertical channels adjacent side edges of the second side wall and configured to hold a third graphic panel between the opposing vertical channels.

9. The display stand of claim 8, further comprising a second table assembly, the second side wall defining a second pocket, the second table assembly configured to be moved between a stored position wherein the second table assembly is disposed within the second pocket of the second side wall and a deployed position wherein a portion of the table assembly extends substantially perpendicularly to the second side wall, by pivoting along an axis where the table assembly intersects the first side wall.

10. The display stand of claim 1, further comprising a video screen coupled to the counter top panel.

11. The display stand of claim 1, further comprising a light source configured to illuminate at least one of the first graphic panel and second graphic panel.

12. A display stand comprising:

a display stand housing, the display stand housing comprising a first side wall, the first side wall comprising opposing vertical channels, the first side wall configured to hold one or more graphic panels between the opposing vertical channels, the first side wall further comprising a recessed portion defining a table pocket;

a table assembly intersecting the display stand housing and configured to move between a stored configuration and a deployed configuration by pivoting along an axis where the table assembly intersects the first side wall, the table assembly configured to be disposed within the table pocket and concealed from view by at least one of the graphic panels when in the stored configuration; and a counter top panel disposed over the display stand housing.

13. The display stand of claim 12, the display stand housing comprising a front wall, back wall, first side wall, and second side wall.

14. The display stand of claim 12, the table assembly comprising a table top and a folding leg.

15. The display stand of claim 12, the counter top panel coupled to the display stand housing with a hinge.

16. The display stand of claim 12, further comprising a literature rack coupled to the counter top panel.

17. The display stand of claim 12, further comprising a base unit coupled to the display stand housing, the base unit having a top surface, the top surface of the base unit comprising a pair of depressions configured to receive the feet of a chair.

* * * * *